United States Patent [19]

Mason, Jr. et al.

[11] Patent Number: 4,955,617

[45] Date of Patent: Sep. 11, 1990

[54] KIT FOR BOARD GAMES

[76] Inventors: Stanley I. Mason, Jr., 61 River Rd., Weston, Conn. 06883; Elizabeth L. Fuller, 72 River Rd., both of Weston, Conn. 06883; Roy E. Doty, 35 Grey Hollow Rd., Norwalk, Conn. 06850

[21] Appl. No.: 407,556

[22] Filed: Sep. 15, 1989

Related U.S. Application Data

[63] Continuation of Ser. No. 282,747, Dec. 12, 1988, abandoned.

[51] Int. Cl.[5] ..... A63F 3/00

[52] U.S. Cl. ..... 273/256; 273/276; 273/290

[58] Field of Search ..... 273/256, 243, 249, 246, 273/250–254, 290, 288, 276

[56] References Cited

U.S. PATENT DOCUMENTS

| | | | |
|---|---|---|---|
| 1,616,328 | 2/1927 | Nix | 273/246 |
| 1,697,023 | 1/1929 | Rottenburg | 273/246 |
| 2,044,122 | 6/1936 | Michener | 273/246 |
| 3,481,605 | 12/1969 | Giraurd et al. | 273/246 |
| 4,343,475 | 8/1982 | Stader | 273/276 |

FOREIGN PATENT DOCUMENTS

| | | | |
|---|---|---|---|
| 921873 | 5/1947 | France | 273/246 |

*Primary Examiner*—Benjamin Layno

*Attorney, Agent, or Firm*—Haynes N. Johnson

[57] ABSTRACT

A game kit is provided with movable playing pieces, movable barriers, and a game board having a circumferential track. The track includes pluralities of sequential spaces to receive the movable pieces, as a player moves them around said track, and barrier spaces running across the width of the tracks to receive the movable barriers. The barrier spaces on the tracks are between pairs of the sequential spaces. The board also has two diamentrical tracks, transverse to one another, interconnecting opposite sides of the circumferential track. The movable barriers are designed to interfit with one another such that the barriers may be stacked or interfitted end to end, to provide either extra height or extra length. As a result, one or more of the movable barriers can be positioned in the barrier spaces to provide variable height and length deterrents to moving the movable playing pieces in the circumferential track while playing the game.

5 Claims, 3 Drawing Sheets

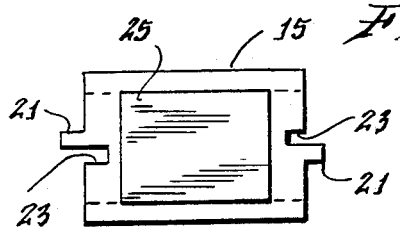
Fig. 3.
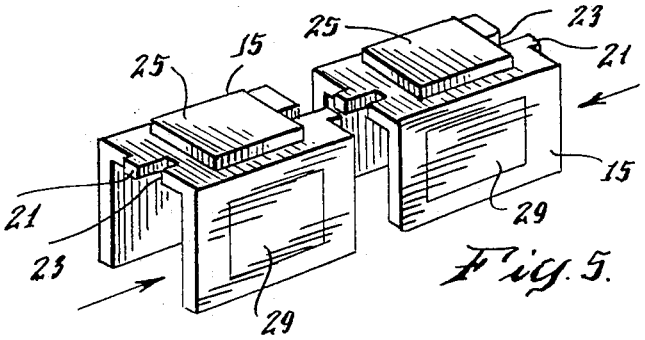
Fig. 5.
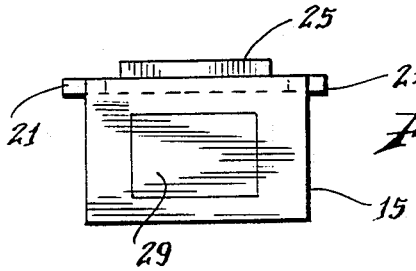
Fig. 4.
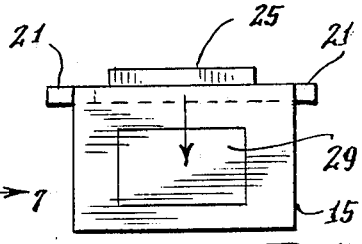
Fig. 6.
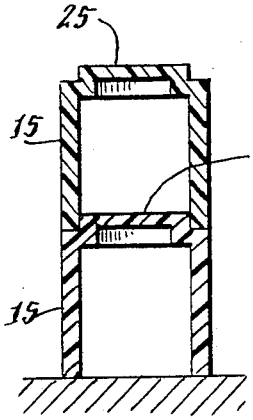
Fig. 7.
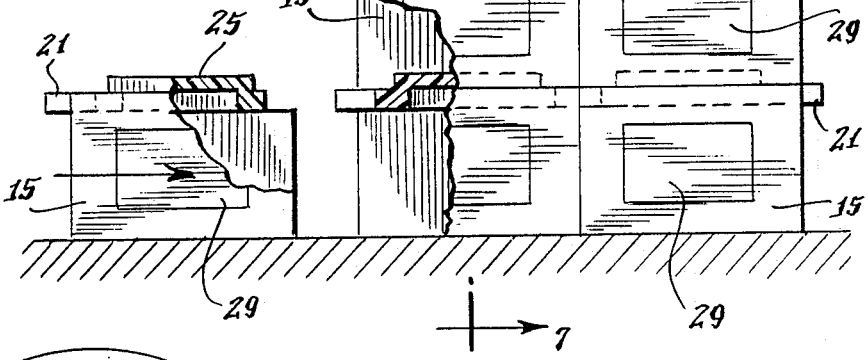
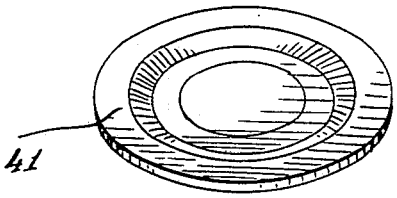
Fig. 10.
Fig. 8.
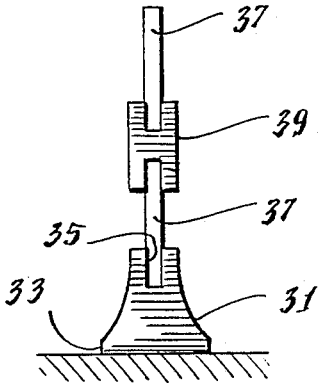
Fig. 9.
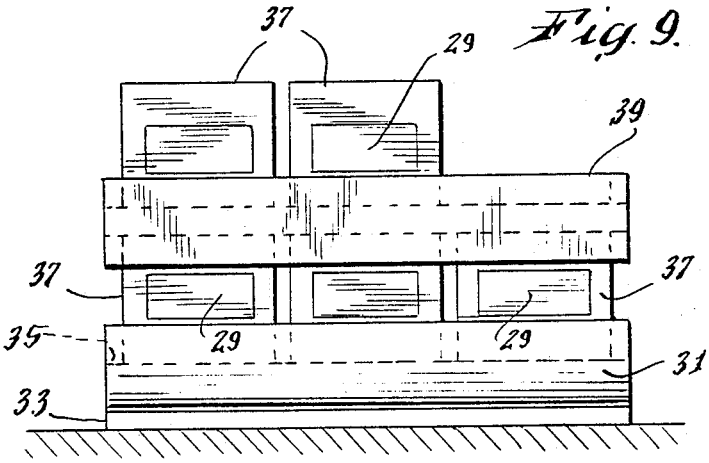

KIT FOR BOARD GAMES

This application is a continuation of application Ser. No. 07/282,747, filed Dec. 12, 1988 now abandoned.

FIELD OF THE INVENTION

Our invention relates to the field of board games and, in particular, to a kit for a board game which includes the use of movement barriers which can be changed in size and, so, used for different purposes.

BACKGROUND OF THE INVENTION

Various kinds of board games have, of course, existed in the past. They have included boards with tracks for the movement of paying pieces, but are not believed to have included such systems with movable and adjustable barriers.

BRIEF SUMMARY OF THE INVENTION

A game kit is provided including movable playing pieces, movable barriers, and a game board having a circumferential track. The track includes pluralities of sequential spaces to receive said movable pieces, as a player moves them around said track, and barrier spaces running across the width of the tracks to receive the movable barriers. The barrier spaces on the tracks are between pairs of the sequential spaces. The board also has two diametrical tracks, transverse to one another, interconnecting opposite sides of the circumferential track. The diametrical tracks also include spaces to receive the movable pieces, but no spaces for the removable barriers.

The movable barriers are designed to interfit with one another such that the barriers may be stacked or interfitted end to end, to provide either extra height or extra length. As a result, one or more of the movable barriers can be positioned in the barrier spaces to provide variable height and length deterrents to moving the movable playing pieces in the circumferential track while playing the game.

DESCRIPTION OF THE DRAWINGS

FIGS. 3 and 4 are top plan and side elevational views, respectively, of one form of barrier piece.

FIG. 5 is an exploded view showing how these barrier pieces are joined end to end.

FIG. 6 is a side elevation, partially broken away, showing these barrier pieces joined both end to end and on top of one another.

FIG. 7 is a vertical section, taken on line 7—7 of FIG. 6.

FIG. 8 is an end elevation of a stack of modified barrier pieces.

FIG. 9 is a side elevation showing several of the modified barrier pieces joined end to end and one above another.

FIG. 10 is a perspective view of one form of movable playing piece, such as a plate-shaped piece.

DETAILED DESCRIPTION OF THE INVENTION

Figure 1:
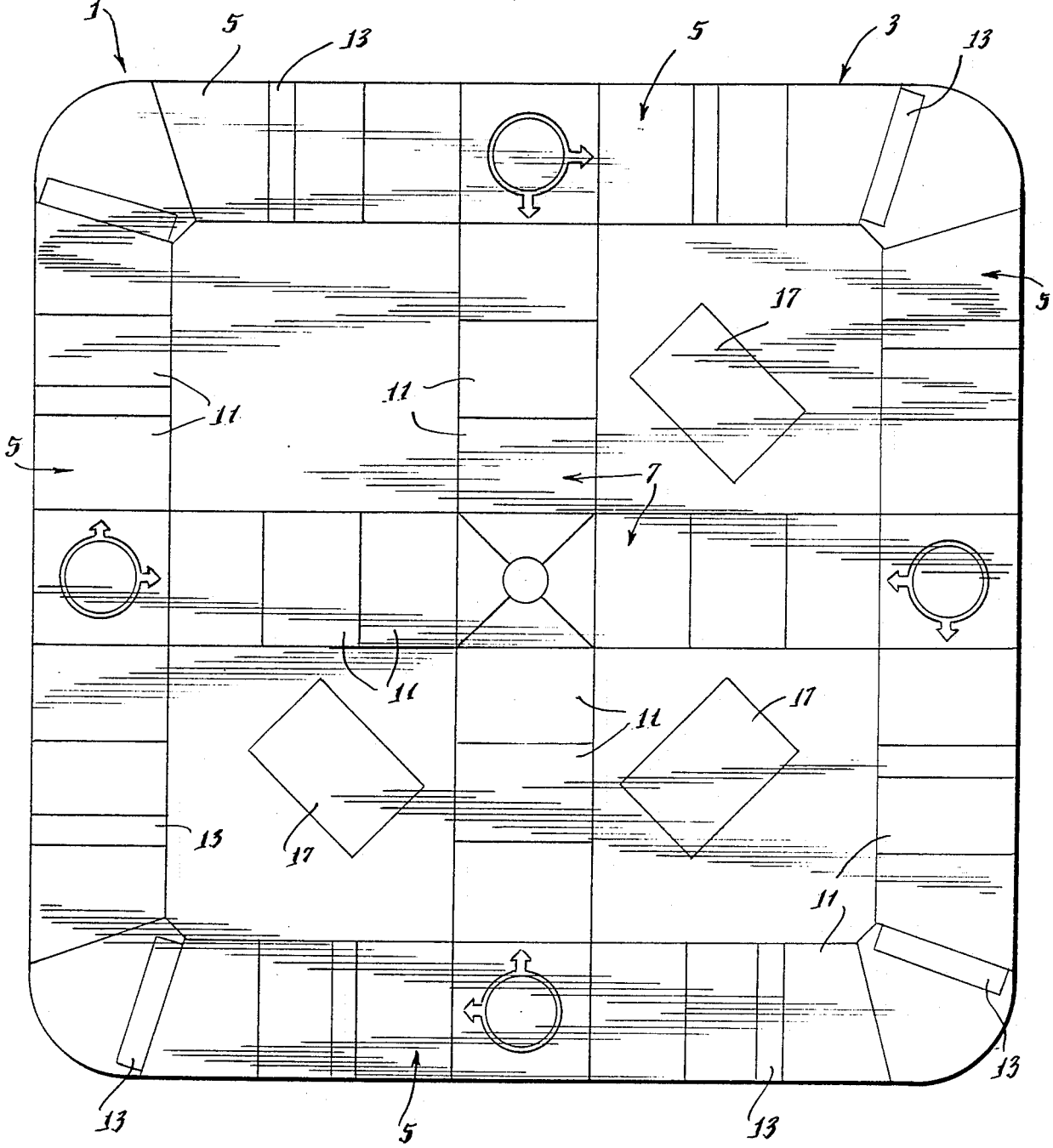
FIG. 1 is a plan view of the board used with this game kit. It shows the circumferential track with its sequential spaces and the barrier spaces; it also shows the two diametrical tracks.
Figure 2:
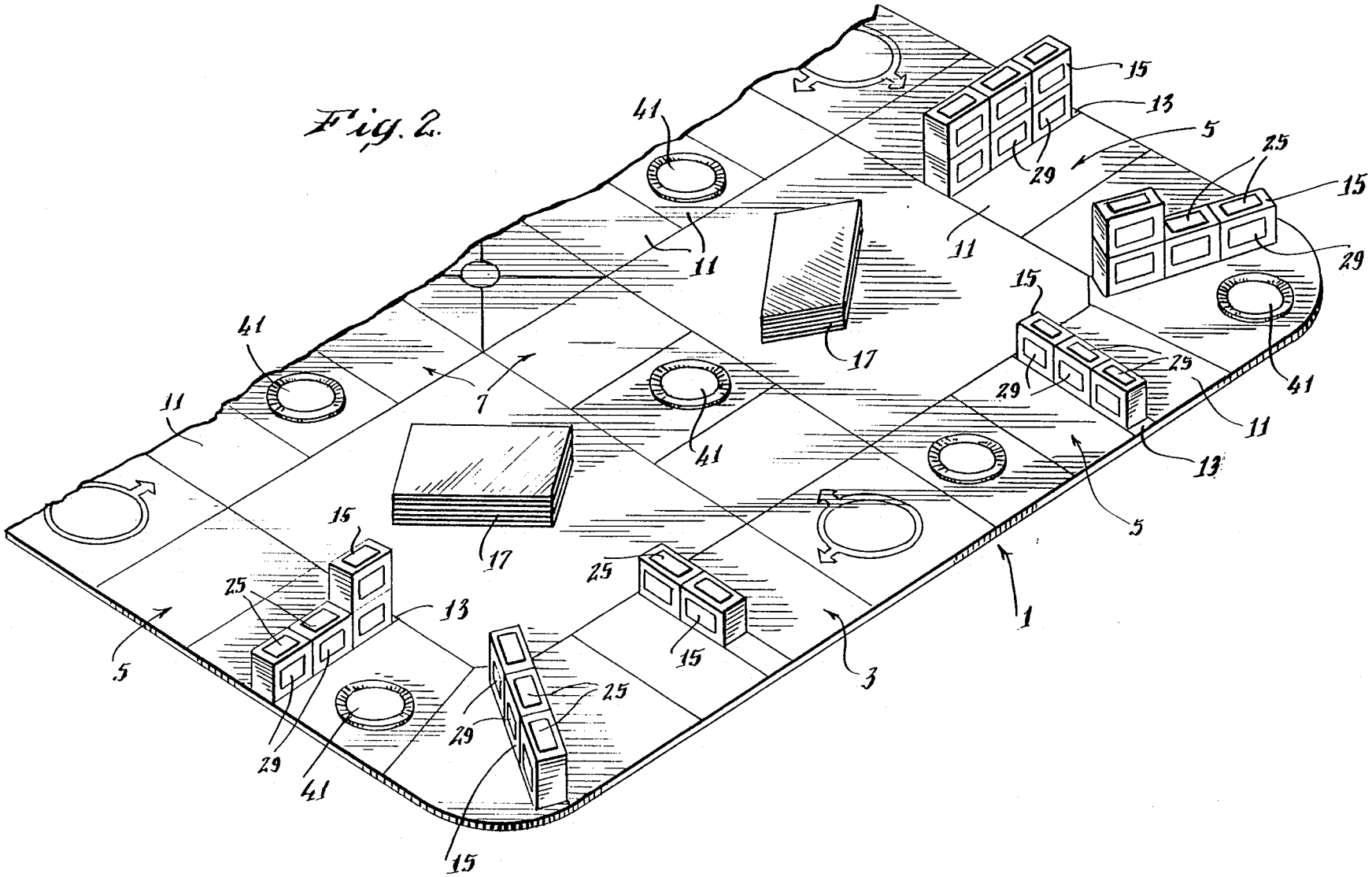
FIG. 2 is a partial perspective view of the board showing various barriers positioned in barrier spaces.

The game kit 1 of our invention includes a board 3, barriers 15, game cards 17 bearing "consequences" for the players, and movable playing pieces 41. It may also include dice or some equivalent (not shown) and sometimes play money (not shown).

Board 3 has two types of tracks printed on it. One is a circumferential track 5; the other is two diametrical tracks 7 at right angles to one another and connecting opposite sides of the circumferential tracks 5. The circumferential tracks are made up on two types of playing spaces, sequential spaces 11 and slightly smaller barrier spaces 13. Both types of spaces extend the width of the track 5, though the barrier spaces normally have a slightly lesser width. The sequential spaces may be in groups of, say, two or three spaces adjacent to one another. The barrier spaces are individual spaces with sequential spaces on either side of them in the track.

The diametrical tracks are made up of sequential spaces, the barrier spaces not being needed in those tracks. Players may, at their option, use the diametrical track to avoid the barriers, but may be penalized in some manner under the rules for so doing.

As an element in the game, players can, in accordance with the game rules, erect barriers 15 on their "property", i.e.,their barrier spaces 13, to prevent other players from passing along the circumferential track over the barriers, or to prevent it until a sum of "money" has been paid. The game rules would determine the conditions, such as chance or payment of money, under which barriers could be erected. These barriers would be erected in barrier spaces 13.

One type of barrier 15 is shown in FIGS. 3 through 7. These are generally rectangular box-like pieces that are made to be joined end to end for greater length and stacked for greater height. The type and amount of joining will, under the rules, affect the payments required of other players. The barriers 15 may include different pictures 29 on their sides which represent different consequences under the rules of the game.

Barriers 15 include longitudinally extending flanges 21 on opposite ends and, adjacent to the flanges, keyed portions 23 to receive the flanges from other barrier pieces. The keys and flanges complement each other so that barriers 15 made be joined end to end.

The barriers also include upper plates 25 positioned above the upper surfaces of the barriers 15 and smaller than the upper surfaces. The bottoms of the barriers have recesses 27 of a shape and size complementing the plates in order to receive the plates of barriers placed below them.

The keys and flanges and the plates and recesses are made of materials which, and are so dimensioned as to, result in frictional interconnecting fit. Thus, the individual barrier units may be secured to one another end to end or one above the other, or both, to provide for barriers 15 which together are of different dimensions.

Another type of barrier 15 is shown in FIGS. 8 and 9. This includes a support 31, preferably with a length the same as the width of track 5, i.e., the length of the barrier spaces 13. Support 31 has a wide base 33 and a slot 35 along its upper surface. Several cards 37 may fit into the slot 35. Additional pieces, having an H-shaped cross section with slots on the top and bottom, may be fitted above cards 37, thus allowing an additional row of cards above the first row.

We claim:

1. A board game kit including movable playing pieces, movable barriers, a game board, said board having a circumferential track thereon, said track including pluralities of sequential spaces to receive said movable pieces, as a player moves them around said track, said sequential spaces running the width of said track, and barrier spaces running across the width of said tracks to receive said movable barriers, said barrier spaces being positioned between pairs of said pluralities of sequential spaces, said board including at least one diametrical track interconnecting opposite sides of said circumferential tracks, said diametrical track being formed of additional said sequential spaces to receive said movable pieces, and said movable barriers being shaped such that said barriers may be secured to one another end to end or stacked one above another, whereby said one or more of said movable barriers can be positioned in a said barrier space thereby providing deterrents to moving said movable pieces in said circumferential track while playing said game.

2. A game kit as set forth in claim 1 and including two said diametrical tracks, said diametrical tracks being substantially transverse to one another.

3. A game kit as set forth in claim 1 in which said barriers include complementary flanges and keys on opposite ends thereof and complementary upper plates and lower recesses, whereby said barriers may be interfitted with one another.

4. A game kit as set forth in claim 1 in which said barriers can be stacked.

5. A game kit as set forth in claim 1 in which a plurality of barrier spaces are positioned between at least one pair of said plurality of sequential spaces.

* * * * *